US007199721B2

(12) United States Patent
Shirlee

(10) Patent No.: US 7,199,721 B2
(45) Date of Patent: Apr. 3, 2007

(54) ALARM SHUT OFF SYSTEM

(75) Inventor: Harold Shirlee, 5406 Dreher La., Little Rock, AR (US) 72209

(73) Assignee: Harold Shirlee, Little Rock, AR (US)

( * ) Notice: Subject to any disclaimer, the term of this patent is extended or adjusted under 35 U.S.C. 154(b) by 112 days.

(21) Appl. No.: 11/037,946

(22) Filed: Mar. 31, 2005

(65) Prior Publication Data

US 2006/0232431 A1 Oct. 19, 2006

(51) Int. Cl.
*G08B 17/10* (2006.01)

(52) U.S. Cl. ..... 340/628; 340/506; 340/532; 340/577; 340/584; 340/632; 169/61; 137/78.4

(58) Field of Classification Search ..... 340/506, 340/532, 577, 584, 628, 632; 169/61; 137/78.4
See application file for complete search history.

(56) References Cited

U.S. PATENT DOCUMENTS 5,936,531 A * 8/1999 Powers ..... 340/628
6,032,663 A * 3/2000 Pencheon ..... 126/42
6,172,612 B1 * 1/2001 Odachowski ..... 340/628
6,199,573 B1 * 3/2001 Paskiewicz ..... 137/79

* cited by examiner

*Primary Examiner*—Jeffery Hofsass
*Assistant Examiner*—Samuel J Walk

(57) ABSTRACT

The Alarm Shut Off System is an invention that will detect when there is smoke and shut off the supply of gas or electric power from the appliance to prevent the smoke from growing into a fire. This invention will save lives and property.

2 Claims, 3 Drawing Sheets

*THE SMOKE ALARM TO THE "ALARM SHUT OFF SYSTEM"*

ALARM SHUT OFF SYSTEM

This invention make claim to the provisional patent 60/538,587 filed Jan. 23, 2004.

BACKGROUND OF THE INVENTION

The invention relates to a smoke alarm system that will not only detect when there is smoke, but will shut off the supply of gas or electric power from the appliance to prevent the smoke from growing into a fire.

There are many types of smoke alarm systems already in use. However, many of these will only detect when there is smoke or a fire. There are some that will respond to the smoke or fire by a water sprinkle system. With the water sprinkle system sometimes that which is not damaged by the smoke and fire is damaged by the water sprinkle system.

Unfortunately, there isn't a smoke or fire alarm system that will actually prevent the smoke from growing into a fire without causing other damages (like water damage). Thus, there is a need for a system that will not only detect smoke, but will go a step further and prevent the smoke from growing into a fire without adding farther damage. This is what this "Alarm Shut Off System" does. This invention will detect the smoke and then shut the supply of gas or electric power off from the appliance. This will prevent the smoke from growing into a fire without adding farther damage (like water damage). This will save lives and property.

SUMMARY OF THE INVENTION

The object of this invention is to provide a smoke or fire alarm system that will prevent a smoke from growing into a fire without adding farther damage. To accomplish this objective an "Alarm Shut Off System" will be installed between the supply line (gas or electric) and the appliance. The smoke detector that comes with the system has a TRANSMITTER wired inside of the smoke detector. When the smoke detector is activated to send out the alarm warning signal the TRANSMITTER is activated to send out a signal to the RECEIVER on the Alarm Shut Off System.

The RECEIVER will receive the signal from the Alarm TRANSMITTER. When the RECEIVER receives the signal from the Alarm TRANSMITTER the RECEIVER will activate the TIMER.

The TIMER has a DIAL. Each number on the DIAL represents 30 seconds. You can select the amount of time you want before the GAS or the ELECTRIC supply is shut off by the Alarm Shut Off System. If you bring the situation under control before the TIMER reaches the number you have selected, you should push the OVERRIDE BUTTON. This will stop the TIMER and prevent the GAS or ELECTRIC supply from be shut off from the appliance.

However, if no one is around or you fail to bring the situation under control before the selected amount of time on the TIMER DIAL is reached the Alarm Shut Off System will automatically shut the supply of GAS or ELECTRIC off from the appliance to prevent the situation from growing into a fire.

Figure 1:
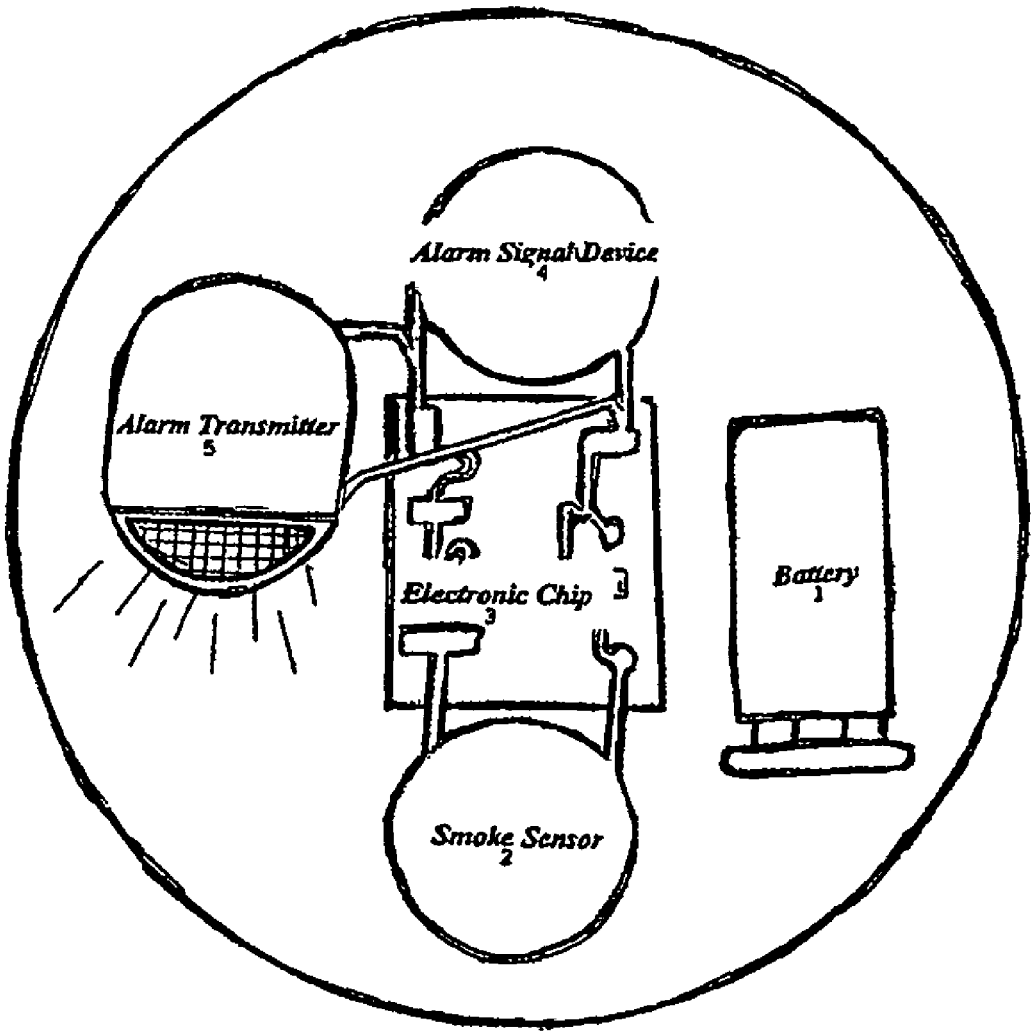
FIG. 1 is an illustration of the parts and operation of the smoke alarm detector.
Figure 2:
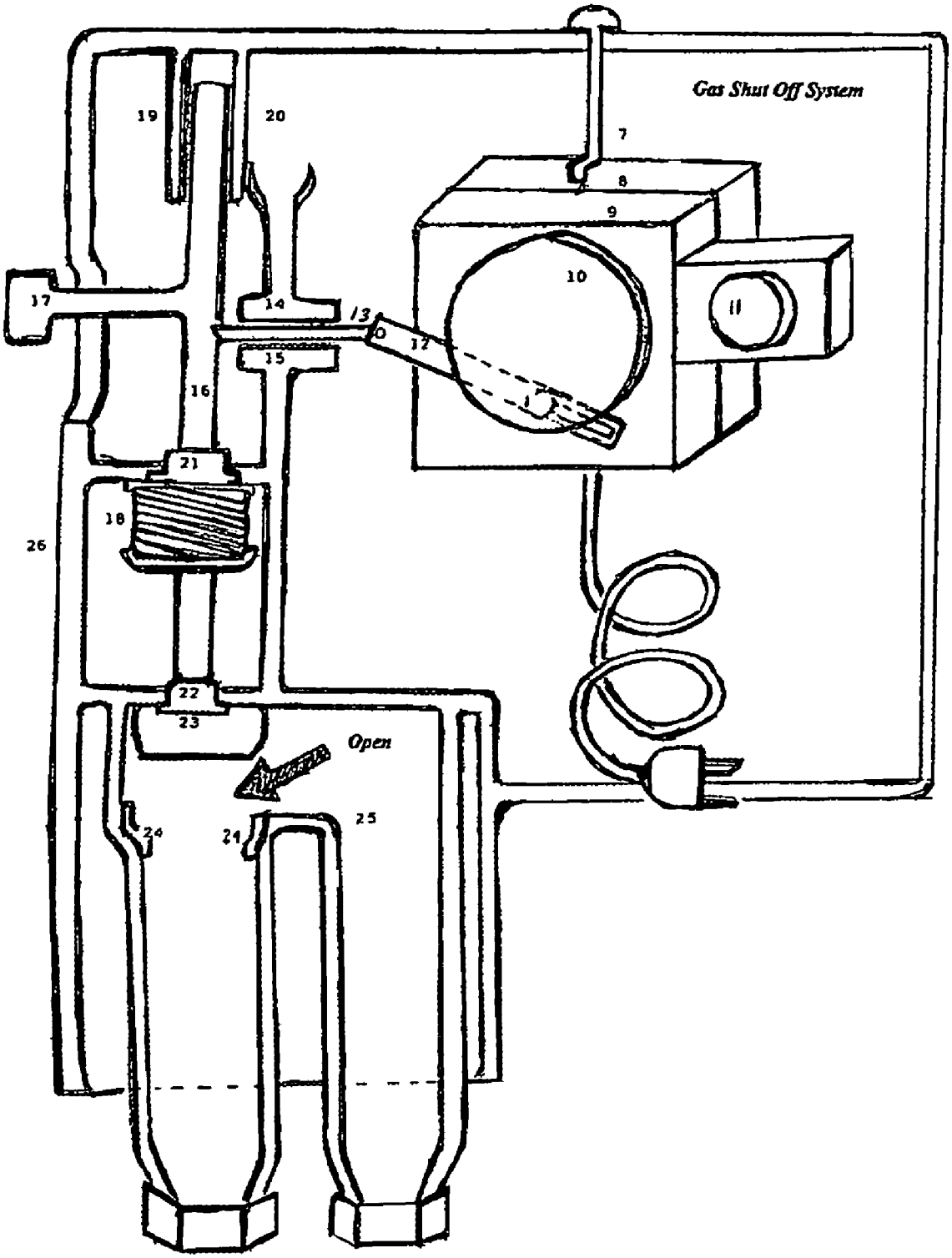
FIG. 2 is an illustration of the gas alarm shut off system.
Figure 3:
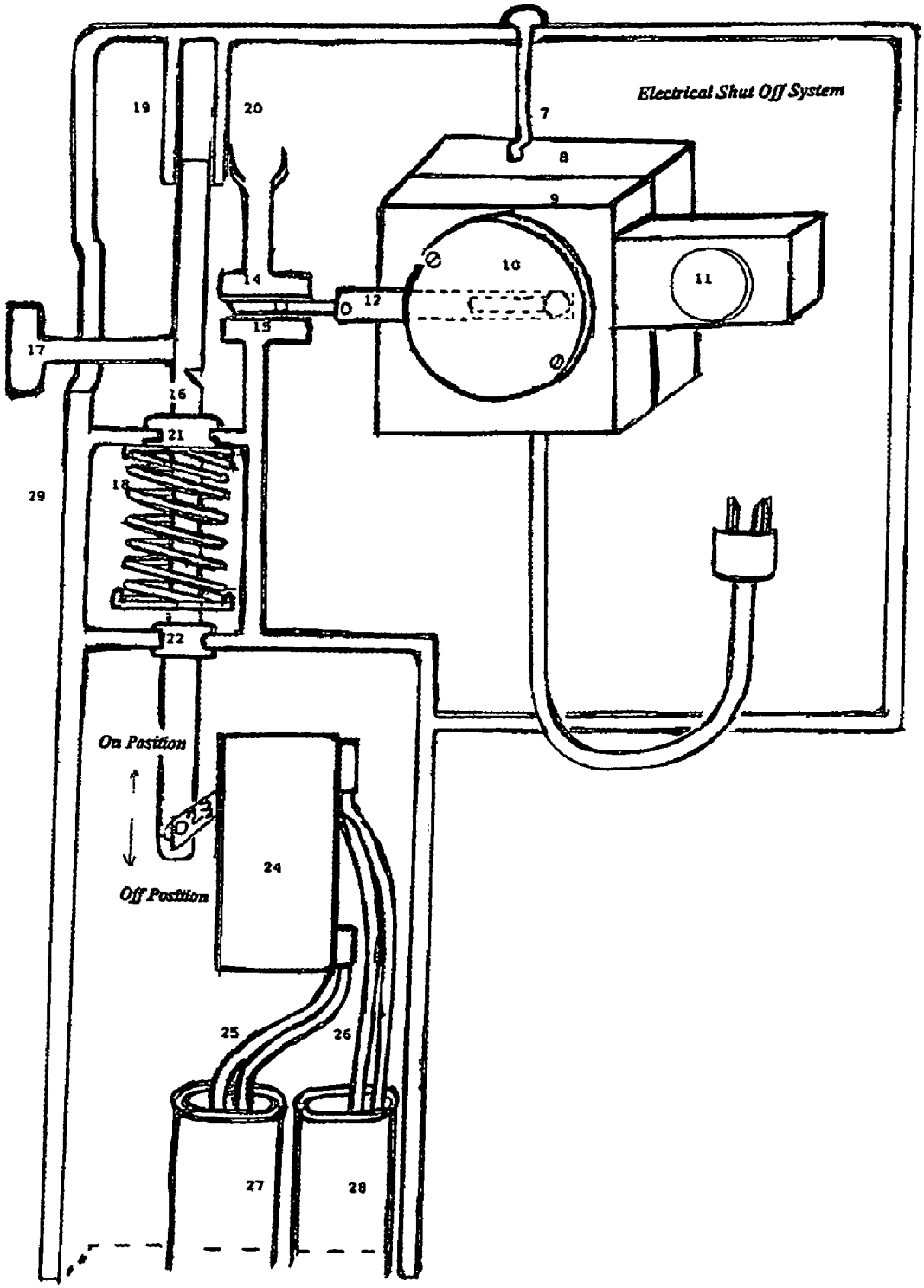
FIG. 3 is an illustration of the electric alarm shut off system.

DETAILED DESCRIPTION AND OPERATION OF THE SMOKE ALARM SHUT OFF SYSTEM: GAS AND ELECTRIC

Starting with the SMOKE DETECTOR ALARM (drawing 1) that comes as a part of the Alarm Shut Off System. It is operated by battery (1). First the smoke sensor (2) will detect smoke. It will send that detection through the electronic chip (3) to the alarm signal device (4) that makes the smoke alarm sound. The alarm transmitter (5) is wired directly into the alarm signal device (4). Therefore, the same signal that the electronic chip (3) sends to the alarm signal device (4) is also sent to the alarm transmitter (5). This signal activates the alarm transmitter (5) that sends out a signal to the receiver antenna (6) on the Alarm Shut Off System.

Detailed Description and Operation of the Gas Alarm Shut Off System (Drawing 2)

(First, the electrical cord from timer (6) is already pluged into a wall outlet from installation). The signal from the alarm transmitter (5) is received by the shut off timer signal receiver antenna (7). The receiver (8) receives the signal and starts the timer (9) that starts the dial wheel (10).

A situation that is brought under control: If the situation is brought under control before the timer dial wheel (10) reaches the selected number on the dial wheel (10) the override button (11) should be pushed. This will stop the timer dial wheel (10). The override button (11) will stay in the override engage position. The Shut Off System will not shut off the supply of gas from the appliance. Once the smoke condition has cleared to the point that the smoke alarm has stopped, the override button (11) should be pushed again. This will disengage the override button (11). Then the dial wheel (10) should be reset to the desired setting.

A situation that is not brought under control (maybe a pot is left cooking on the stove and no one is around): Starting with the timer dial wheel (10) in motion. When the timer dial wheel (10) has run to the end of the slot on the trigger pin lever (12) it will pull the trigger pin (13), through the upper trigger pin guide (14) and the lower trigger pin guide (15) from the shut off shaft (16). This will allow the shut off tension spring (18) to release. This will cause the shut off shaft (16) to slide down through the left upper shaft guide (19) and the right upper shaft guide (20), through the upper gas seal (21) and through the lower gas seal (22). This forces the shut off cap (23) down to the incoming gas supply line shut off seal (24). With the gas supply being shut off from the supply line to the appliance (25) the smoke will not grow into a fire. Thus, lives and property have been saved.

RESET: With the right hand turn dial wheel (10) clockwise until the trigger pin lever (12) pushes the trigger pin (13) until it hits the shut off shaft (16). Keep a slight amount of pressure on the dial wheel (10). With the left hand lift the off and on lever (17) up to on position. You will feel the trigger pin (13) fall into the lock position. The Alarm Shut Off System is back in operation.

Detailed Description and Operation of the Electric Alarm Shut Off System

Repeating the detailed description and operation of the SMOKE DETECTOR ALARM (drawing 1) that operates the GAS ALARM SHUT OFF SYSTEM (DRAWING 2) it performs the same operation on the ELECTRIC ALARM SHUT OFF SYSTEM. It is operated by battery (1). First the smoke sensor (2) will detect smoke. It will send that detection through the electronic chip (3) to the alarm signal device (4) that makes the smoke alarm sound. The alarm transmitter (5) is wired directly into the alarm signal device (4). Therefore, the same signal that the electronic chip (3) sends to the alarm signal device (4) is also sent to the alarm transmitter (5). This signal activates the alarm transmitter (5) that sends out a signal to the receiver antenna (6) on the Electric Alarm Shut Off System.

Detailed Description and Operation of the Electric Alarm Shut Off System (Drawing 3)

(First, the electric cord from timer (6) is already pluged into a wall outlet from installation). The signal from the alarm transmitter (5) is received by the shut off timer signal receiver antenna (7). The receiver (8) receives the signal and starts the times (9) that starts the dial wheel (10).

A situation that is brought under control: If the situation is brought under control before the timer dial wheel (10) reaches the selected number on the dial wheel (10) the override button (11) should be pushed. This will stop the timer dial wheel (10). The override button (11) will stay in the override engaged position. The Shut Off System will not shut off the electric supply from the appliance.

Once the smoke condition has cleared to the point that the smoke alarm has stopped, the override button (11) should be pushed again. This will disengage the override button (11). Then the dial wheel (10) should be reset to the desired setting.

A situation that is not brought under control (maybe a pot is left cooking on the stove and no one is around): Starting with the time dial wheel (10) in motion. When the timer dial wheel (10) has run to the end of the slot on the trigger pin lever (12) it will pull the trigger pin (13) through the upper trigger pin guide (14) and the lower trigger pin guide (15) from the shut off shaft (16). This will allow the shut off tension spring (18) to release. This will cause the shut off shaft (16) to slide down through the left upper shaft guide (19) and the right upper shaft guide (20), through the upper bearing (21) and through the lower bearing (22) causing the shut off shaft (16) to push the breaker switch (23) into the off position, causing the breaker (24) to stop the electric power supply on the incoming electric line (25) in conduiet (27) from going to the appliance supply line (26) in conduiet (28). This stops the smoke from growing into a fire.

RESET: With the right hand turn the dial wheel (10) clockwise until the trigger pin lever (12) pushes the trigger pin (13) until it hits the shut off shaft (16). Keep a slight amount of pressure on the dial wheel (10). With the left hand lift the off and on lever (17) up to on position. You will feel the trigger pin (13) fall into the lock position. The Shut Off System is back in operation.

I claim:

1. A smoke alarm comprising:

a battery (1) that powers a smoke sensor (2) that sends a signal to electronic chip (3) to the alarm signal device (4) to the alarm transmitter (5) that sends a signal to a gas alarm shut off system that is powered by a timer electrical cord (6) that causes the receiver antenna (7) to receive signal from transmitter (5) that sends signal to receiver (8) to timer (9) that starts dial wheel (10) if override button (11) is not pushed, dial wheel (10) will engage trigger pin lever (12) that will pull trigger pin (13) through upper trigger pin guide (14) and lower trigger pin guide (15), pulling trigger pin (13) from shut off shaft (16) moving off and on lever (17) to off position, releasing tension spring (18) causing the shut off shaft (16) to move through left shaft guide (19), right shaft guide (20), upper gas seal (21), lower gas seal (22) forcing shut off cap (23) through incoming gas supply line (24) into incoming gas seal (24) stopping the supply of gas to gas supply line (25) to the appliance.

2. The smoke alarm as set forth in claim 1, send signal to ELECTRIC alarm shut off system that is powered by a timer electrical cord (6) that causes the receiver antenna (7) to receive signal from transmitter (5) that sends signal to receiver (8) to timer (9) that starts dial wheel (10), if override button (11) is not pushed, dial wheel (10) will engage trigger pin lever (12) that will pull trigger pin (13) through upper trigger pin guide (14) and lower trigger guide (15) pulling trigger (13) from shut off shaft (16) moving off and on lever (17) to off position, releasing tension spring (18) causing the shut off shaft to move through left shaft guide (19), right shaft guide (20), upper shaft bearing (21), lower shaft bearing (22), pushing breaker off and on switch (23) to off position that causes the breaker (24) to be off, which stops the incoming electric supply line (25) in conduit (27) from sending electric to the power supply line (26) in conduit (28) to the appliance.

* * * * *